United States Patent [19]

Aksola

[11] 4,249,856

[45] Feb. 10, 1981

[54] CONTROL APPARATUS FOR AIR INTAKE IN OIL BURNERS OF HEATING BOILERS

[76] Inventor: Tauno Aksola, Suomen, Järvelä, Finland

[21] Appl. No.: 946,657

[22] Filed: Sep. 28, 1978

[30] Foreign Application Priority Data

Oct. 3, 1977 [FI] Finland ..... 772914

[51] Int. Cl.[3] ..... F01D 17/00; F01D 17/12

[52] U.S. Cl. ..... 415/25; 415/157; 431/89

[58] Field of Search ..... 415/25, 30, 32, 36, 415/157; 431/89, 90; 220/287

[56] References Cited

U.S. PATENT DOCUMENTS

| | | | |
|---|---|---|---|
| 2,459,815 | 1/1949 | Hammell | 415/157 |
| 2,464,698 | 3/1949 | Logan | 431/89 |
| 3,149,662 | 9/1964 | Irwin | 431/90 |

FOREIGN PATENT DOCUMENTS

| | | | |
|---|---|---|---|
| 7510531 | 10/1976 | France | 220/287 |

*Primary Examiner*—Louis J. Casaregola
*Attorney, Agent, or Firm*—Steinberg & Raskin

[57] ABSTRACT

Apparatus for controlling air intake through the air intake aperture of the oil burner in a heating boiler includes a rotary coupling member adapted to be connected to the shaft of the oil pump and/or air blower so that it extends substantially along the axis of the intake aperture, a first sleeve member detachably mounted on the coupling member, a second sleeve member slidably mounted on the first sleeve member and to which a closure member is affixed for axial movement away from and towards to open and close, respectively, the intake aperture. At least one spring member is provided whose ends are connected to respective ones of the first and second sleeve members thereby interconnecting the same. A weight is fixed to the body of the spring member so that upon starting the boiler causing the pump and/or blower shafts to rotate, the closure member moves axially away from the air intake aperture to open the same under the centrifugal force acting on the weight member while upon stopping the boiler with the consequent stopping of the pump and/or blower shafts, the closure member moves axially towards the air intake aperture to close the same under the force of the spring member.

16 Claims, 6 Drawing Figures

FIG. 1
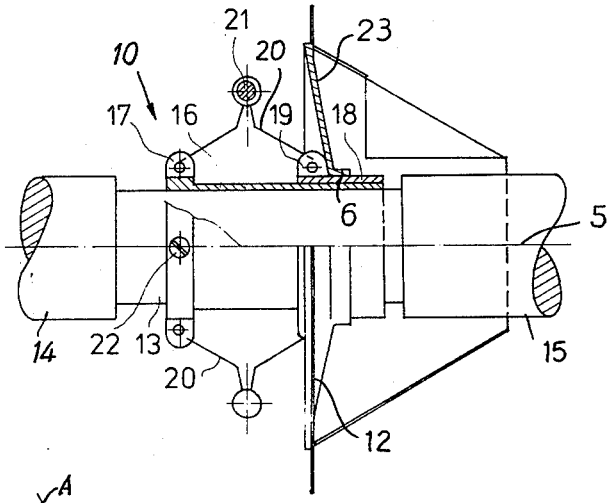
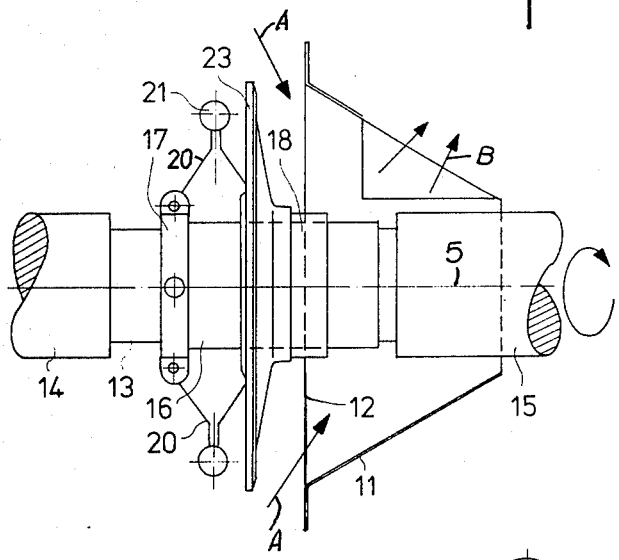
FIG. 2
FIG. 3
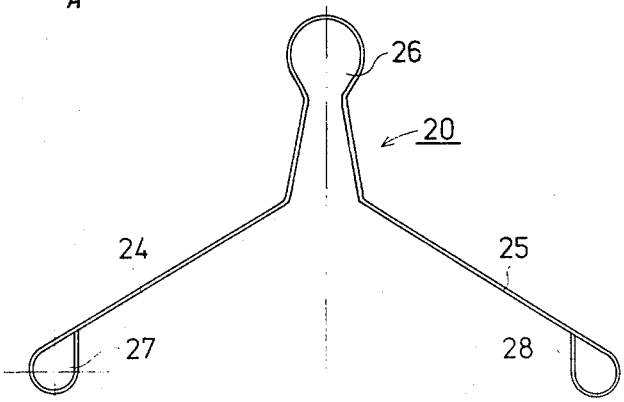

CONTROL APPARATUS FOR AIR INTAKE IN OIL BURNERS OF HEATING BOILERS

BACKGROUND OF THE INVENTION

This invention relates generally to control apparatus for regulating the air intake in oil burners of heating boilers and, more particularly, to such regulating apparatus which employ a closure member which is axially movable with respect to the air intake aperture of the oil burner in response to the actuation and deactuation of the heating boiler.

It is of course well known to utilize heating boilers equipped with oil burners for the central heating systems of buildings, such for example, as single family dwellings. In such applications it is conventional to regulate the interior temperature by actuating and deactuating the oil burner of the boiler through the use of a temperature responsive or thermostatic switch which monitors the temperature of the boiler water.

Conventional oil burners utilized in connection with heating boilers are of course provided with air intake apertures for the purpose of providing a flow of air through the boiler to accomplish combustion of the oil. However, upon the temperature of the water in the boiler reaching the desired level whereby the thermostatic switch deactuates the oil burner rendering it inoperative, a flow of air will normally still be maintained through the oil burner. Such air flow through the burner while the boiler is in its inoperative condition tends to cool the boiler thereby resulting in an overall decrease in the efficiency of the system. The fact that it is not unusual for the temperature in the boiler room of a single family dwelling to be relatively low further aggravates this deleterious decrease in boiler efficiency by cooling the boiler water more rapidly than if the surrounding environment were at a higher temperature. Cooling of the boiler water when the boiler is in its inoperative mode of course results in a more frequent actuation of the thermostatic switch thereby resulting in a substantially continuous operation of the oil burner which of course results in a higher consumption of fuel oil then would be otherwise necessary.

The flow of air through the oil burner can be prevented by closing either the flue gas passage of the air intake aperture of the oil burner. Since closing the flue gas passage requires relatively specialized equipment which is rather complex and therefore expensive, this solution has not been found practical, especially in the case of single family dwellings.

Accordingly, apparatus have been designed to provide a closure for the air intake aperture of the oil burner. Thus, for example, in one previously proposed design, a flap has been eccentrically pivoted to the air intake duct which tends to remain closed under the force of gravity but which will open by virtue of the suction forces supplied by the blower upon actuation of the boiler. However, this design has proven rather unreliable in service due to the fact that it has been necessary to construct the flap of heavy material so that it tends to remain positvely closed under all conditions, such as in windy weather. The use of such a heavy flap in connection with the air intake aperture of the oil burner has proven to have an unfavorable effect on the operation of the latter. A typical draft valve utilized on the intake side of the blower of the oil burner is illustrated in Swedish Pat. Nos. 173,033 and 176,218.

Other attempts have been made to provide closure apparatus for the air intake aperture of oil burners for regulating the air intake thereto. For example, German Pat. No. 918,955 discloses a closure plate for opening and closing the intake aperture in response to the actuation and deactuation, respectively, of the heating boiler. In this particular design, the movement of the closure plate is accomplished utilizing pneumatic means. Additionally, hydraulically controlled closure plates are currently being utilized in connection with the regulation of intake air to the oil burner.

However, regardless of whether the control of the movement of the closure plate is effected by the suction provided by the blower or through the use of hydraulic or pneumatic cylinders, such prior apparatus have been found not to be satisfactory. Thus, as mentioned above, the use of suction to control the movement of the closure plate has been found to be unreliable, requiring the use of a safety switch. The use of hydraulic and pneumatic systems for controlling the movement of the closure plate requires relatively expensive ancillary equipment which is often awkward if not impossible to provide on existing burners. Of course, in connection with hydraulic and pneumatic systems, external energy sources are required or, alternatively, such systems must be connected to the oil pump of the burner itself which is relatively cumbersome and expensive.

It has therefore been proposed to utilize centrifugal force in connection with the operation of the closure plate of the intake aperture of an oil burner. Thus, in designs employing the centrifugal force principle, there is no need for the provision of external energy to accomplish the movement of the closure plate. Such a design is disclosed in U.S. Pat. No. 3,149,662, which describes apparatus wherein the opening and closing of the intake aperture of the oil burner is accomplished through the use of centrifugal force. However, the design disclosed therein is structurally complex and, therefore impractical.

SUMMARY OF THE INVENTION

Accordingly, one object of the present invention is to provide a new and improved apparatus for controlling the air intake through an air intake aperture provided in an oil burner in a heating boiler which eliminates the drawbacks mentioned above.

Another object of the present invention is to provide such control apparatus which utilizes centrifugal force in connection with its operation.

Still another object of the present invention is to provide a new and improved control apparatus which is relatively simple in construction and which may be used in heating systems found in single family dwellings. Still another object of the present invention is to provide control apparatus which may be used in connection with a wide variety of oil burner designs which are presently on the market.

Still yet another object of the present invention is to provide a control apparatus which is reliable in operation. Yet another object of the present invention is to provide control apparatus which may be adjusted to regulate the extent of opening of the air intake aperture.

Briefly, in accordance with the present invention, these and other objects are attained by providing control apparatus including a closure member movably mounted in an axial direction with respect to the intake aperture of the oil burner for the purpose of opening and closing the same when the oil burner is actuated and deactuated, respectively. The movement of the closure member to open the air intake aperture is effected by centrifugal force while the movement of the closure member to close the air intake aperture is effected by a spring force.

More particularly, a coupling member is provided which is adapted to be connected to the driving member of the oil pump and/or blower of the oil burner. The coupling member extends substantially axially with respect to the air intake aperture of the burner. A first sleeve member is detachably mounted on the coupling member and a second sleeve member is axially slidably mounted on the first sleeve member, the intake aperture closure member being fixedly mounted on the second sleeve member. The first and second sleeve members are interconnected by at least one spring member which is provided with a centrally mounted weight. Upon actuation of the heating boiler by thermostatic means or the like, the coupling member is rotated causing the weight attached to the spring to move radially outwardly under centrifugal force which thereby causes the second sleeve member to axially move over the first sleeve member thereby causing the closure member to move away from the air intake aperture to open the same. Deactuation of the heating boiler causes the rotation of the coupling member to cease whereupon the second sleeve member slides with respect to the first sleeve member under the spring force in a manner to bring the closure member towards and into engagement with the intake aperture thereby closing the same.

Various advantages are obtained through the use of the above described apparatus. Thus, the apparatus is relatively simple and reliable in operation and results in remarkable savings in fuel oil consumption by preventing the flow of air though the oil burner when the heating boiler is deactivated. By providing that the first sleeve member is detachably mounted on the coupling member, the extent of opening of the intake aperture may be regulated by prestressing the spring member when the boiler is in its deactivated state. The apparatus may be used in connection with air intake apertures of various diameters since various size closure plates having central openings of constant size are easily provided. Thus, the apparatus of the present invention is suitable for use in connection with various types of burners.

DESCRIPTION OF THE DRAWINGS

A more complete appreciation of the invention and many of the attendant advantages thereof will be readily appreciated as the same becomes better understood by reference to the detailed description in connection with the drawings in which:

FIG. 1 is a schematic side elevation view of the apparatus of the present invention wherein the closure member is in its closed position.

FIG. 2 is a schematic side elevation view of the apparatus of the present invention wherein the closure member is in its open position.

FIG. 3 is a detail view of the spring member employed in connection with the apparatus of the present invention.

DESCRIPTION OF THE PREFERRED EMBODIMENTS

Figure 4:
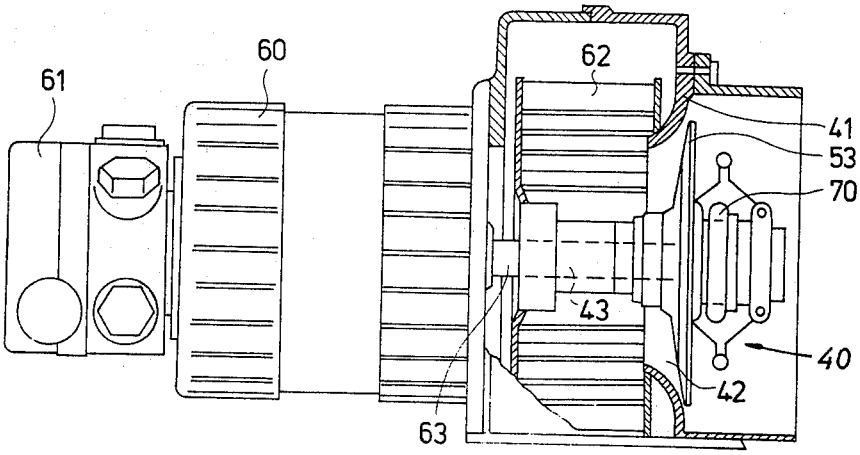
FIG. 4 is a side elevation view in partial section of another embodiment of the present invention shown in combination with an oil burner.

Referring now to the drawings wherein like reference characters designate identical or corresponding parts throughout the several views, and more particularly to FIGS. 1 and 2, one embodiment of the control apparatus of the present invention, generally designated 10, is illustrated, control apparatus 10 being adapted to selectively open and close the air intake aperture 12 of an oil burner of a heating boiler. More particularly, the air intake aperture 12 is defined by a wall member 11 having the configuration of a truncated cone. As described in detail below, control apparatus 10 is operatively associated with rotary mounted couplings 14, 15 provided on the shafts of the oil pump and air blower (not shown) which comprise conventional components of an oil burner. Thus, the oil pump in a conventional oil burner, upon actuation of a thermostatic switch, provides a flow of oil to the nozzle tube, through the nozzle and into the fire chamber of the oil burner. Similarly upon actuation of the burner, the air blower causes an air flow to enter the air intake aperture 12, designated by the arrow A in FIG. 2, which air is then directed into the fire chamber as shown by the arrows B. The rotary mounted couplings 14, 15 connected to the shafts of the pump and blower, respectively are mounted for rotation about an axis 5 which substantially coincides with the central longitudinal axis of the air intake aperture 12. It is of course understood that the shaft couplings 14, 15 remain stationary until such time as the temperature of the water in the boiler decreases to the point where the thermostatic switch actuates the boiler whereupon the pump and air blower initiate operation thereby causing the rotation of the respective shafts and, of course, shaft couplings 14, 15.

According to the present invention, a cylindrical shaft coupling 13, preferably formed of an elastomeric material, such as rubber, has its ends connected to the respective ends of the pump and blower shaft couplings 14, 15 as shown in FIGS. 1 and 2, for rotation therewith. As shown in FIGS. 1 and 2, the coupling 13 is itself mounted for rotation substantially about the centrally extending longitudinal axis 5 of the air intake aperture 12. Prior to positioning and fixing coupling 13 between the pump and blower couplings 14, 15, a cylindrical sleeve member 16 is located thereover and fixed thereto in a detachable manner by means of a set screw 22. The axial location of the sleeve member 16 on coupling 13 may be selectively adjusted for purposes which will be made clear below by loosening set screw 22, repositioning sleeve member 16 with respect to coupling 13 and retightening the set screw 22. A circumferentially extending flange-like protuberance 17 is formed on the end region of sleeve member 16 remote from the air intake aperture 12 or, in other words, the left end region thereof as seen in FIGS. 1 and 2.

A second cylindrical sleeve member 18 of considerably shorter axial length then sleeve member 16 is disposed over the latter and is suitably dimensioned so as to be axially slidable with respect thereto. A circumferentially extending flange-like protuberance 19, similar to protuberance 17, is formed on the end region of the second sleeve member 18 which is proximal to the protuberance 17 formed on sleeve member 16. Thus, the second sleeve member 18 is slidable over the body portion of sleeve member 16 in a manner such that protuberances 17, 19 of sleeve members 16, 18, respectively, can move towards and away from each other. A closure member 23, in the present embodiment comprises a dish shaped member having a central opening defined by an axially extending shoulder 6. Closure member 23 is located over the slidable sleeve member 18 by passing the latter through the central opening thereof, closure member 23 being fixed to the slidable sleeve member 18 by conventional means, such as by welding shoulder 6 to the outer surface of sleeve member 18. Closure member 23 has an outer peripheral dimension slightly larger than the diameter of the air intake aperture 12 so that when closure member 23 is located in the position shown in FIG. 1, the outer edge regions of closure member 23 will engage the outer edges of the conical wall member 11 thereby fluidly sealing the air intake aperture 12.

Sleeve members 16 and 18 are interconnected by means of a spring member 20, best seen in FIG. 3. Spring member 20 is defined by a formed wire member having a pair of leg portions 24, 25 which extend upwardly towards each other in an oblique manner. Leg portions 24, 25 are integrally connected by an upwardly extending central portion which defines an upper circular collar portion 26. The terminal end portions of spring leg portions 24, 25 are formed in the shape of loops 27, 28 and are respectively connected to the protuberances 17, 19 of sleeve members 16, 18. It is understood that spring member 20 is shown in its unstressed condition in FIGS. 1 and 3 and is constructed of conventional spring wire having a certain resiliency which tends to return spring member 20 to the configuration shown in FIGS. 1 and 3 upon deformation thereof. It is further seen in FIG. 1 that more than one spring member 20 may interconnect sleeve members 16, 18, such for example as two spring members 20 as shown in the figures.

Upon attaching the loop end portions 27, 28 of each spring member 20 to the respective protuberances 17, 19 of sleeve members 16, 18, the relative axial positions of the sleeve members are determined, assuming spring members 20 are in their undeformed or unstressed conditions. In assembly of the control apparatus of the present invention, the set screw 22 is loosened and the sleeve member 16 positioned over coupling 13 such that the closure member 23 is in sealed engagement with the edge portions of air intake aperture 12 with spring members 20 being in their unstressed or slightly stressed condition. The set screw 22 is then tightened to fix the axial position of sleeve member 16 with respect to coupling 13.

A weight member 21, which may comprise a cylindrical lead slug or the like, is disposed within the collar portion 26 of each of the spring members 20. Thus, the outer dimension of the weight member is preferably sightly larger than the maximum dimension of the space defined by collar portion 26 so that the weight member 21 is securely held therein.

In operation, upon the temperature of the boiler water falling below a given predetermined value, a thermostatic switch activates the operation of the oil burner which, of course, actuates the drive shafts and, therefore, the shaft couplings 14, 15 of the oil pump and air blower. The coupling member 13 is thereby rotated whereby the sleeve members 16, 18 are set into rotary motion as are spring members 20 which are carried thereby. As a result of this rotary motion, centrifugal force acts on the rotating weight members 21 carried on spring members 20 in an outward radial direction. However, since the terminal portion 27 of spring member 20 is fixed in position by virtue of its being connected to the fixed sleeve member 16, outward radial movement of weight members 21 results in the movement of the other terminal end portion 28 of spring member 20 in an axial direction towards protuberance 17. This axial movement of the spring member end portion 28 causes sleeve member 18 to slide over sleeve member 16 towards the left as best seen in FIG. 2 thereby moving closure member 23 out of sealing engagement with air intake aperture 12. So long as the oil burner continues in operation with consequent rotation of the control apparatus of the present invention, the closure member 23 will remain out of sealing engagement with air intake aperture 12 thereby allowing the free flow of air through the aperture as indicated by arrow a in FIG. 2. When the boiler water attains a sufficiently high temperature, the thermostatic switch deactivates the heating boiler whereupon the oil pump and air blower shafts discontinue rotation. At this time, spring members 20 which have been deformed under the centrifugal forces described above, immediately return to their unstressed condition thereby moving the sliding sleeve member 18 and the closure member 23 attached thereto towards the air intake aperture 12 whereupon closure member 23 will move into fluid engagement therewith to close the same.

An important feature of the control apparatus of the present invention is that by virtue of the construction thereof as shown in FIGS. 1 and 2 the apparatus may be adjusted so as to regulate the extent to which the air intake aperture 12 is opened upon actuation of the heating boiler to thereby regulate the amount of air supplied to the burner. More specifically, should it be desired to provide for a lesser quantity of air flow into the air intake aperture upon actuation of the heating boiler, it is only necessary to loosen the set screw 22 and slide the sleeve member 16 over coupling 13 from the position shown in FIG. 1 to a position wherein the spring members 20 are given an initial prestressing or initial deformation, closure member 23 still being in its fluid sealing engagement with aperture 12. Thus, rather then springs 20 being in an initial unstressed or only slightly stressed condition when the heating boiler is deactivated, such spring members will be in an initial prestressed condition. Thus, upon activation of the heating boiler, the centrifugal force acting on weight members 21 will produce an opening movement of closure member 23 which is less then the extent of opening thereof which is obtained in the case where little or no prestressing of spring members 20 is present. Thus, where spring members 20 are initially prestressed or, in other words, are initially deformed, the air intake aperture 12 will be opened to a lesser extent upon activation of the heating boiler with a consequent reduction in the amount of air which can flow therethrough.

Referring now to FIG. 4, another embodiment of the control apparatus of the present invention is illustrated in combination with an oil burner including a motor 60 which drives an oil pump 61 via a shaft (not shown) extending from the left side thereof as seen in FIG. 4, motor 60 also driving an air blower 62 through a shaft 63 extending from the right side of the motor as seen in FIG. 4. The control apparatus, generally designated 40, is mounted on a coupling shaft 43 which extends from the end of the blower drive shaft 63.

Figure 5:
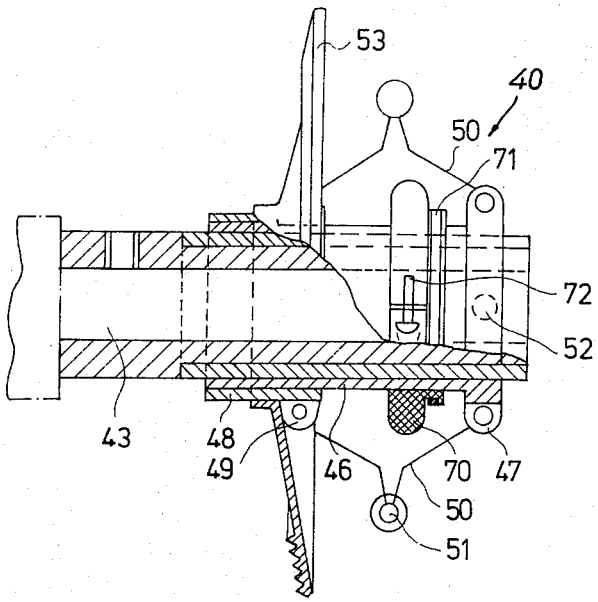
FIG. 5 is a schematic side elevation view in partial section of the apparatus of the present invention employed in connection with the oil burner illustrated in FIG. 4.

Thus, referring to FIG. 4 in conjunction with FIG. 5, the air intake aperture is defined by a substantially conical shaped wall 41 and the coupling shaft 43 extends along the substantial central longitudinal axis of the air intake aperture. The control apparatus 40 generally corresponds to the apparatus described above in connection with FIGS. 1 and 2. Thus, control apparatus 40 comprises a sleeve member 46 which is affixed on the extension shaft coupling 43 by means of a set screw 52. An outer sleeve member 48 is fitted over sleeve member 46 and is axially slidable thereover. Sleeve member 46 is provided with a circumferentially extending flange-like protuberance 47 and, similarly, sleeve member 48 is provided with a circumferentially extending protuberance 49. A dish shaped closure member 53 having a central opening is fitted over sleeve member 48 and affixed thereto. Sleeve members 46 and 48 are interconnected by spring members 50, each of whose terminal portions are respectively connected to protuberances 47, 49 of sleeve members 46, 48. Spring members 50 may have a construction substantially identical to that shown in FIG. 3. Weight members 51 are similarly provided in the central portions of the spring members. Of course, the control apparatus 40 illustrated in FIGS. 4 and 5 is located over the extension shaft coupling 43 in the same manner as the control apparatus 10 of the FIGS. 1 and 2 embodiment. Thus, with the set screw 52 in its loosened condition, sleeve member 48 is positioned over the extension shaft coupling 43 until the closure member 53 is in sealed engagement with the air intake aperture. Spring members 50 may be provided in their unstressed or in a prestressed condition depending upon the extent of opening of the air intake aperture desired upon activation of the heating boiler.

The extent of opening of the air intake aperture may be regulated by means other then the precompression of prestressing of spring members 50 described above. Thus, as seen in FIGS. 4 and 5, an adjustment ring 70 is provided which circumferentially extends around sleeve member 46 and which is secured thereto at the desired position by means of a set screw 72. Adjustment ring 70 has an annular groove in which a suitable spring 71 is disposed. Thus, upon activation of the heating boiler, by virtue of the centrifugal force acting on weight members 51, closure member 53 will move outwardly away from the air intake aperture opening the same to an in-flow of air drawn in by blower 62. The closure member 53 will move axially over sleeve member 46 until it abuts the adjustment ring 70 which, of course, limits the axial movement of closure member 53. Accordingly, should it be desired to increase the air flow through the air intake aperture, it is only necessary to reposition adjustment ring 70 at a location further from the air intake aperture and, conversely, should it be desired to restrict the air flow through the air intake aperture, it is only necessary to move the adjustment ring to a position closer thereto. Of course, it is possible to provide an adjustment ring similar to that shown in FIGS. 4 and 5 in connection with the apparatus illustrated in FIGS. 1 and 2.

Figure 6:
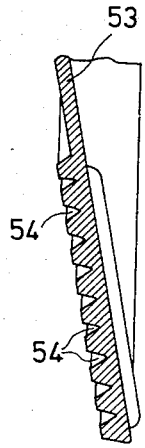
FIG. 6 is a partial detail view in section of the closure means of the present invention.

Referring to FIG. 6, an advantageous embodiment of the closure member 53 (23) is illustrated. Closure plate 53 is provided with a plurality of concentric annular grooves 54, each groove being spaced from the adjacent grooves by a given distance. The manufacture of closure members according to FIG. 6 is advantageous in that such closure plate may be employed in connection with air intake apertures of varying diameters. More specifically, should the closure member be used in connection with a smaller air intake aperture, it is simply necessary to fracture the closure member along the appropriate groove 54 and remove the outer ring shaped portion formed thereby. By this feature, the control apparatus of the present invention can be employed in oil burners having air intake apertures of various diameters. Of course, the closure member 23 utilized in connection with the embodiment of the invention illustrated in FIGS. 1 and 2 may be constructed according to the FIG. 6 embodiment.

Obviously, numerous modifications and variations of the present invention are possible in the light of the above teachings. For example, the embodiment of the control apparatus illustrated in FIGS. 4 through 6 may be provided on the rubber coupling 13 of the embodiment illustrated in FIGS. 1 through 3—3. Of course, the embodiment of the control apparatus illustrated in FIGS. 1–3 may be mounted on the shaft extension coupling 43 illustrated in the embodiment of FIGS. 4–6. Further, spring members having a construction which differs from that shown in FIG. 3 may be employed. Accordingly, it is therefore to be understood that within the scope of the appended claims the invention may be practiced otherwise then as specifically described herein.

What is claimed is:

1. Apparatus for controlling the air intake through an air intake aperture provided in an oil burner in a heating boiler, the boiler including an oil pump and a blower, each of which has a rotary driving member associated therewith, comprising:

a rotatably mounted coupling member adapted to be connected to at least one of said rotary driving members for rotation therewith, said coupling member further being adapted to extend substantially along the axis of the intake aperture;

a first sleeve member detachably mounted on said axially extending coupling member in a normally fixed relation thereto;

a second sleeve member mounted on said first sleeve member in coaxial relation thereto, said second sleeve member being axially slidable over said first sleeve member;

at least one spring member including a pair of leg portions extending obliquely in opposite directions with respect to each other and a central portion interconnecting respective inner ends of said leg portions, said central portion comprising means for holding a weight member, and the respective outer terminal ends of said leg portions each being connected to a respective one of said first and second sleeve members, said spring thereby interconnecting the same;

a weight member located within the holding means of said at least one spring member; and a closure member affixed to said second sleeve member; whereby upon starting the boiler, with consequent rotation of said driving members, said closure member moves axially away from the air intake aperture opening the same due to the centrifugal force acting on said weight member and upon stopping the boiler with consequent stopping of said driving members, said closure member moves axially towards the air intake aperture closing the same under the force of said spring member.

2. Apparatus as recited in claim 1 wherein means are provided for detachably mounting said first sleeve member to said axially extending coupling member so that the axial location of said first sleeve member with respect to said coupling member is selectively adjustable.

3. Apparatus as recited in claim 1 wherein said first and second sleeve members are each provided with a protuberance, said terminal end portions of said at least one spring member being affixed to said respective protuberances.

4. Apparatus as recited in claim 1 wherein said at least one spring member comprises a plurality of spring members and wherein said protuberances each comprises a substantially circumferentially extending protuberance, the terminal end portions of said spring members being affixed to said respective protuberances.

5. Apparatus as recited in claim 1 wherein said central portion is formed having a loop-shape configuration.

6. Apparatus as recited in claim 1 wherein the outer ends of said spring member leg portions are each formed having a loop-shape configuration, said other ends comprising said terminal end portions.

7. Apparatus as recited in claim 6 wherein said first and second sleeve members are each provided with a protuberance, said loop-shape terminal end portions of said spring member being affixed to respective ones of said protuberances.

8. Apparatus as recited in claim 1 wherein said coupling member has a pair of ends, each of said ends being connected to said rotary driving members of said oil pump and blower member respectively.

9. Apparatus as recited in claim 8 wherein said coupling member is formed of an elastomeric material.

10. Apparatus as recited in claim 8 wherein said first sleeve member is detachably mounted on said coupling member by an adjustable set screw.

11. Apparatus as recited in claim 1 wherein said coupling member comprises an extension of a shaft of the blower.

12. Apparatus as recited in claim 11 wherein said first sleeve member is detachably mounted to said coupling member by an adjustable set screw.

13. Apparatus as recited in claim 1 further including an adjustment ring secured on said first sleeve member and means for mounting said adjustment ring on said first sleeve member at any desired axial location thereon.

14. Apparatus as recited in claim 13 further including a spring member provided on said adjustment ring extending around the circumference of said first sleeve member.

15. Apparatus as recited in claim 13 wherein said adjustment ring mounting means comprises a set screw member.

16. Apparatus as recited in claim 1 wherein said closure member comprises a disc-shape member having a plurality of concentrically extending spaced annular grooves formed in the peripheral region on one of the side surfaces thereof.

* * * * *